US005411314A

United States Patent [19]

Wallace

[11] Patent Number: 5,411,314

[45] Date of Patent: May 2, 1995

[54] FOLDABLE TABLE

[76] Inventor: Millard Wallace, 18 Little John Dr., Medford, N.J. 08055

[21] Appl. No.: 148,212

[22] Filed: Nov. 2, 1993

[51] Int. Cl.[6] ..... A47B 3/14

[52] U.S. Cl. ..... 297/158.4; 108/131; 108/133

[58] Field of Search ..... 108/131, 133; 297/159, 297/124

[56] References Cited

U.S. PATENT DOCUMENTS

| | | | |
|---|---|---|---|
| 3,256,037 | 6/1966 | Giambalvo | 297/159 |
| 3,704,674 | 12/1972 | Johnson | 108/118 |
| 4,060,275 | 11/1977 | Hansen | 297/159 |
| 4,382,627 | 5/1983 | Dean | 297/159 X |
| 4,572,574 | 2/1986 | Fischhaber et al. | 297/159 |
| 4,596,196 | 6/1986 | Gunter et al. | 297/159 X |
| 4,648,652 | 5/1987 | Van Kuren | 297/159 |
| 5,018,785 | 5/1991 | Monson et al. | 108/162 X |
| 5,240,307 | 8/1993 | Jones et al. | 297/159 |

*Primary Examiner*—James R. Brittain
*Assistant Examiner*—Robert J. Sandy
*Attorney, Agent, or Firm*—Simpson & Simpson

[57] ABSTRACT

A foldable table is disclosed that comprises three basic parts (a table top assembly, a bench assembly, and four leg assemblies) interactively coupled to form a sturdy table that is easily folded or unfolded. The leg assemblies are spring biased to swing out to the unfolded position and the bench assembly rests on the leg assemblies by the engagement of bench stops on the bench assembly with notches on the leg assemblies. The table is securable in either the folded or unfolded position so that the legs will not unfold when in the folded position unless securing means are released and so that the table will remain fixed in the unfolded position unless securing means are released.

3 Claims, 4 Drawing Sheets

FOLDABLE TABLE

BACKGROUND OF THE INVENTION

The present invention relates to tables and, more particularly, to tables having bench seats attached thereto and which can be folded into a convenient storage and shipping unit. In its unfolded position, the present invention is a picnic table; when folded into its storage or shipping position, the table is only 7 inches high. The table is designed to be as sturdy as a nonfoldable picnic table when in use, but it also is easily foldable.

There are many foldable tables in the prior art. One of the problems associated with the prior art foldable tables is that they were designed primarily to fold, so that, when they are set up in their unfolded position for use, they are not as sturdy as a nonfoldable table.

Another problem with the prior art foldable tables is that they often require a substantial amount of manipulation to convert them from the folded position to the unfolded position.

An additional problem with prior art foldable tables is that they often require the use of a substantial amount of hardware such as hinges or tracks to enable the folding of the table, thereby increasing the cost and complication of manufacture.

U.S. Pat. No. 1,351,013 to Stine discloses a folding table which includes many hinged portions and brace bars 12, 14 and 15 which detach from the unit when it is in a folded position. The user unfolds the table by manipulating the hinged portions into the correct position and inserting the brace bars in the appropriate location.

U.S. Pat. No. 2,257,550 to Gay teaches a table similar to Stine, but with hinges at different locations and which does not require detachable brace bars. As with Stine, the Gay table top is divided into two hinged portions, thereby leaving a weak spot on the table top at the hinge location.

U.S. Pat. No. 4,572,574 to Fischhaber et al (hereinafter Fischhaber) teaches a foldable picnic table having a one-piece table top and a seat assembly interconnected to the table top. The legs of the table top include upper mounting bolts that fit into slideways that are part of cross-braces attached to the table top. In use, the upper mounting bolts slide along the slideway to folded or unfolded positions, thereby enabling the legs to be folded up next to the table top.

U.S. Pat. No. 4,648,652 to VanKuren teaches a folding table having a one-piece table top and legs which are hinged so that they can be folded upwardly under the table top. Slide members are mounted in tracks on the underside of the benches of the table. Transverse bars connect each set of legs at either end of the table, and each end of each transverse bar is connected to the slide members, such that, when the legs are folded under the table, the slide members allow the transverse bars to move out of the way.

Each of the above cited inventions requires the user to perform substantial manipulation of the table components in order to fold or unfold the table. Further, the designs, while allowing the tables to be foldable, result in less than adequate structural integrity when in the unfolded position. In addition, each of the cited inventions requires the addition of many hinges and/or the addition of slideways or tracks, thereby adding to the cost and time of manufacture.

SUMMARY OF THE INVENTION

It is an object of the present invention to provide a table that has interconnected bench seats that can easily fold into a storage or shipping position.

It is another object of the present invention to provide a table that has interconnected bench seats that can easily fold into a storage or shipping position and which, when in use in its unfolded position, has the structural integrity of a standard, non-folding table.

It is another object of the present invention to provide a table that has interconnected bench seats that can easily fold into a storage or shipping position and which, when in use in its unfolded position, has the structural integrity of a standard, non-folding table, and which is simple and easy to fold and unfold, and which is simple and easy to produce.

According to the present invention, the table includes a table top assembly, said table top assembly including a generally rectangular table top, a plurality of table braces attached to said table top and at least two structural braces hingedly attached to at least two of said table braces so that said structural braces can be manipulated between a folded and unfolded position; a bench assembly including two bench brace members which are transversely positioned with respect to said table top, two seat members which are longitudinally positioned with respect to said table top and which are mounted at corresponding ends of said bench brace members and four bench stops, one each coupled to each intersection of said bench braces with said seat members, so that one end of each of said bench stops extends inward towards said table top beyond the inner edge of each seat member; and four leg assemblies, each leg assembly pivotally attached to said table top assembly and comprising a generally parallelogram-shaped leg body, having a rounded heel end for facilitating the pivoting of said leg assembly with respect to said table top, a spring slot cut in the heel end of said leg body to house a spring and spring rod, a spring rod inserted through said spring slot to enable attachment of one end of a spring thereto, a notch for engagement with one of said bench stops when the table is unfolded, and a spring, attached at one end to said spring rod and at the other end to said table top, said table operating such that when all four leg assemblies are folded up underneath said table top assembly and the springs are under tension, the table top assembly rests on top of said bench braces with said structural braces in said folded position, so that an anchoring means can be inserted through said table braces, bench braces, and leg assemblies to anchor said table in said folded position, and when said anchoring means is removed and the entire table structure is lifted by lifting up on the bench assembly, the leg assemblies, forced by the tension of the springs and by gravity, automatically swing out to an unfolded position, and the bench assembly is then lowered into a position such that the bench stops engage the notches, placing the table in the unfolded position.

DETAILED DESCRIPTION OF THE PREFERRED EMBODIMENT

Figure 1:
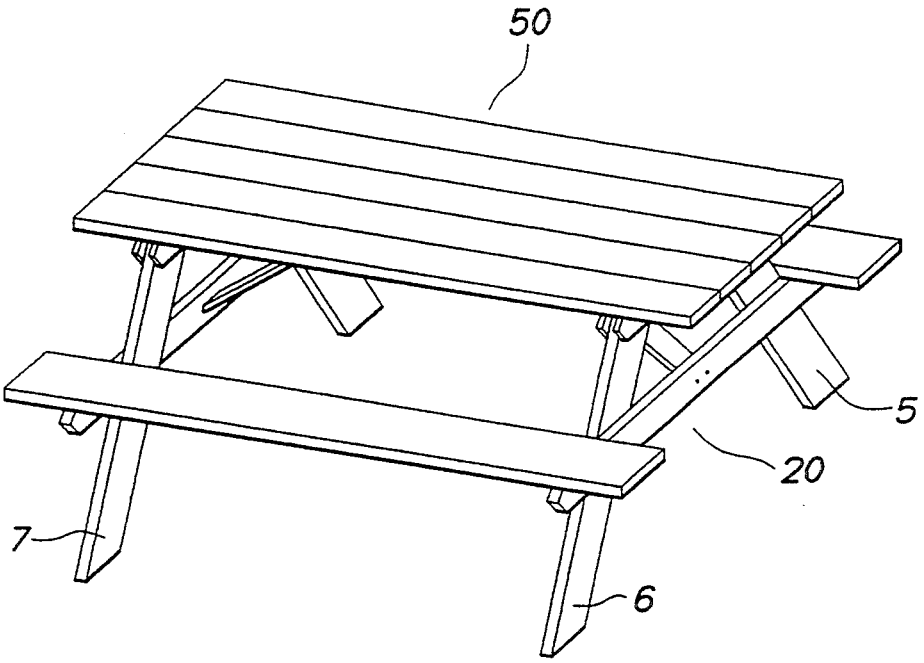
FIG. 1 is a perspective view showing a table, constructed in accordance with present invention, in the unfolded position.
Figure 2:
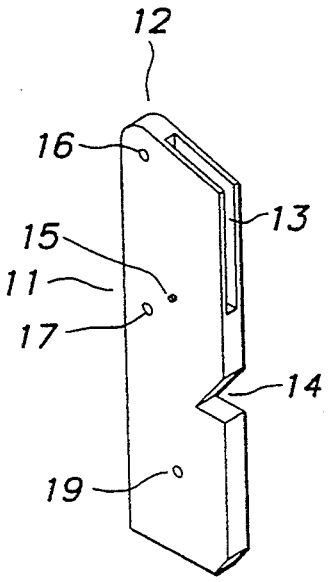
FIG. 2 is a perspective view of a leg assembly of the table of the present invention, separated from the table assembly.
Figure 3:
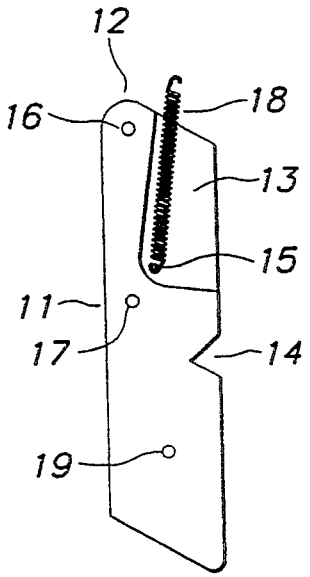
FIG. 3 is a sectional view of the leg assembly shown in FIG. 3.

As can best be seen in FIG. 1, the table of the present invention includes leg assemblies 5, 6, 7 and 8 (hidden from view in FIG. 1), bench assembly 20, and table top assembly 50. Referring to FIGS. 2 and 3, each leg assembly comprises leg body 11 having a rounded heel end 12, a spring slot 13, notch 14, spring rod 15, mounting hole 16, leg storage position anchoring hole 17, and leg open position anchoring hole 19. Leg storage position anchoring hole 17 should be positioned so that it is in alignment with the storage position anchoring holes of the table braces (described below) when the leg assembly is in the folded position. Spring rod 15, which extends through the entire width of the leg body 11 and through the spring slot 13, can comprise a steel pin and is used to enable the attachment of one end of a spring 18, the function of which will be described below. The spring slot 13 allows the springs 18 to be hidden in the leg for both safety and aesthetic reasons. Further, by housing the spring in the spring slot 13, the spring slot 13 acts as guide for keeping the spring 18 in the proper location, and provides a reduction in the amount of tension placed on the spring when the table is in the folded position.

Figure 4:
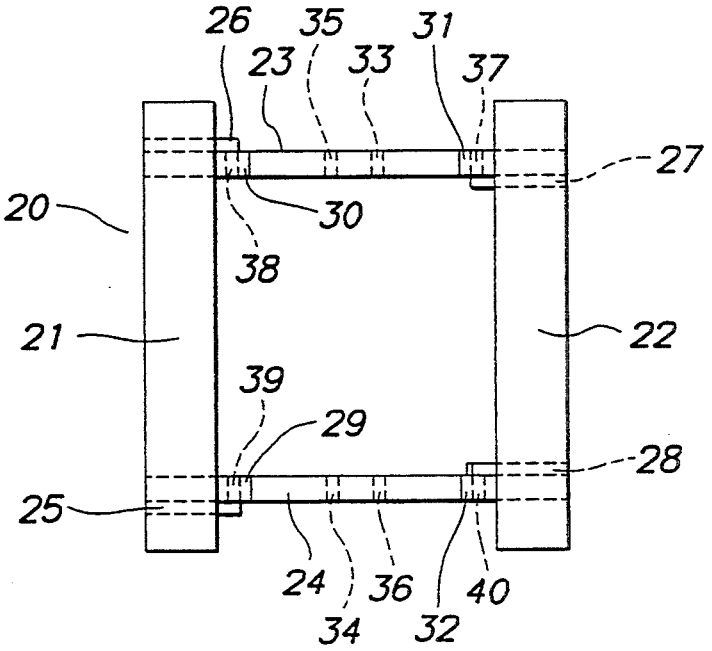
FIG. 4 is a top view of the bench assembly of the present invention separated from the table assembly.
Figure 5:
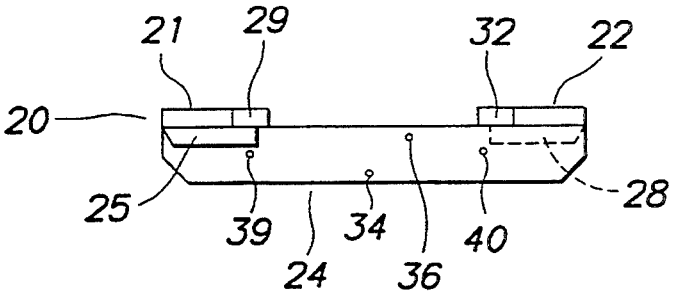
FIG. 5 is a side view of the bench assembly shown in FIG. 4, looking from one end of the table.
Figure 6:
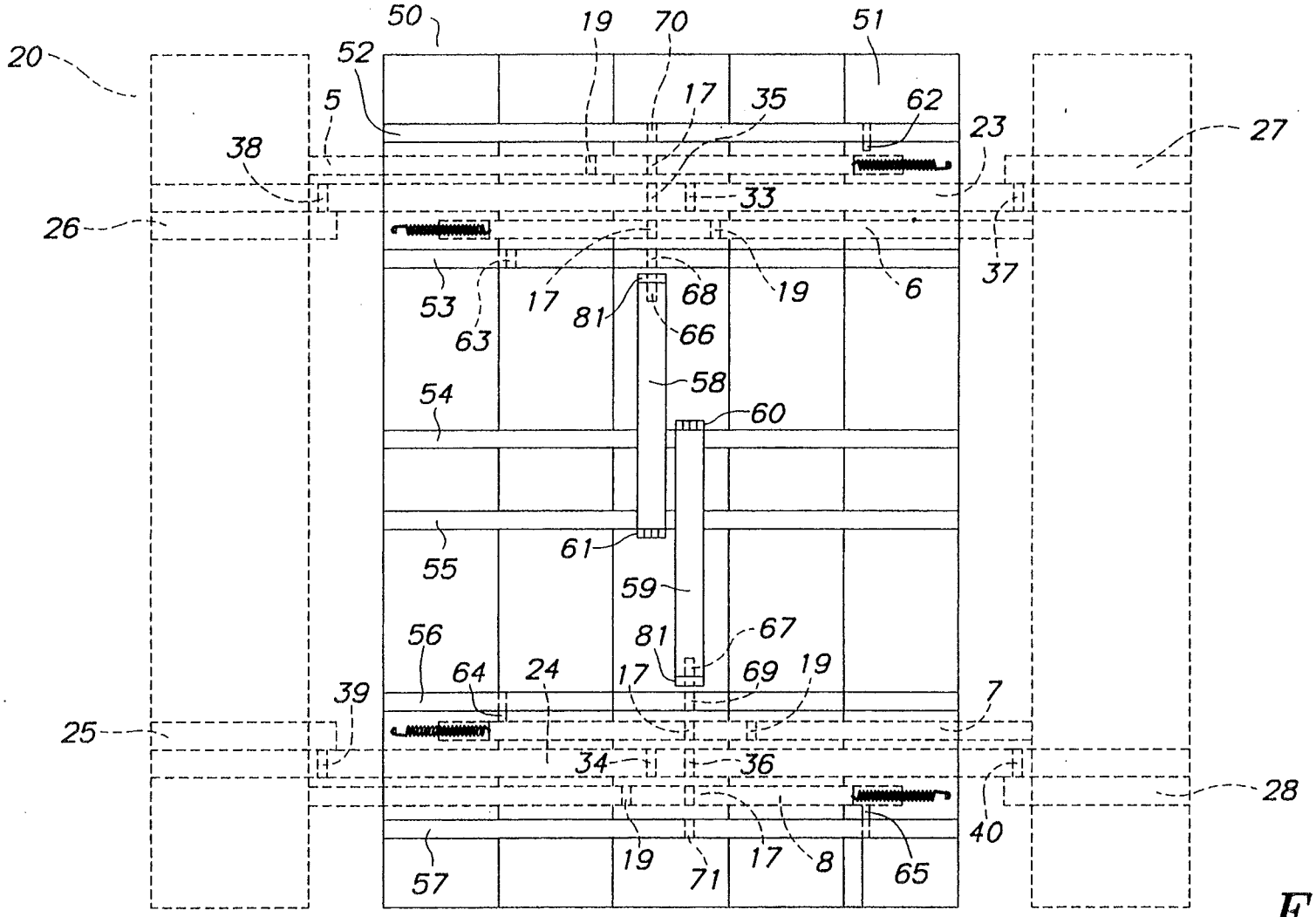
FIG. 6 is a view of the underside of the table top assembly of the present invention, with the leg assemblies and bench assembly drawn in phantom lines.

Referring to FIGS. 4 and 5, a bench assembly 20 comprises benches 21 and 22, braces 23 and 24, stops 25, 26, 27 and 28, and shims 29, 30, 31 and 32. The stops 25, 26, 27 and 28 are attached to braces 23 and 24, and they rest into notches 14 of each leg assembly 5, 6, 7, and 8 when the table is in the unfolded position to support the bench assembly and to assure proper alignment between the legs and the bench assembly. As shown in FIGS. 4–6, stops 25, 26, 27 and 28 can comprise, for example, a block of wood attached to the bench braces directly underneath benches 21 and 22. The outer end of each stop can be flush with the outside edge of benches 21 and 22; the other end of each stop should extend inward beyond the inside edges of benches 21 and 22, so as to allow them to rest into notches 14 when the table is in the unfolded position. Shinis 29, 30, 31 and 32 help in aligning the bench assembly in a proper relationship to the table top when the table is in the folded position and are simply spacers made of, for example, wood which fit snugly between the benches 21 and 22 and the table top 51 when the table is in the folded position.

The notches and stops should be located and sized so that, when the table is in the unfolded position, the leg assemblies 5, 6, 7 and 8 are angled outward, with the bottoms of the leg assemblies further away from the center of the table than the top rounded heel ends 12, as shown in FIG. 1, to provide solid support for the table assembly 50.

Each bench brace 23 and 24 include 2 anchoring holes (37, 38, 39 and 40, respectively) which, when the table is in the unfolded position, should align with leg open position anchoring holes 19 of the leg assemblies. A T-nut or other similar fastening means can be inserted into each anchoring hole 37, 38, 39 and 40 to allow a securing means, such as a machine threaded rod with a handle or knob on the end, to be turned in or out of the anchoring holes.

Each bench brace 23 and 24 also includes structural brace anchoring holes (33 and 34, respectively) and folded position anchoring holes (35 and 36, respectively). The structural brace anchoring holes 33 and 34 must be of a size to allow passage therethrough of a securing means, such as a machine threaded rod with a handle or knob on the end, to be turned in or out of the structural braces as described below. Each structural brace anchoring hole is situated closer to the bottom of the bench braces 23 and 24 than are the folded position anchoring holes 35 and 36, as shown.

FIG. 6 is an underside view of the table top assembly 50, with leg assemblies 5, 6, 7 and 8 and bench assembly 20 shown, in phantom lines, in the folded position. Referring to FIG. 6, table top assembly 50 comprises table top 51, table braces 52, 53, 54, 55, 56, and 57, and hinged structural braces 59 and 58, which are attached to table braces 54 and 55, respectively, by hinges 60 and 61, respectively. Table top 51 can comprise, for example, five 2"×6Δ×6' pieces of knotty cedar which are connected to form table top 51 by securing them to table braces 52–57.

The leg assemblies 5, 6, 7 and 8, bench assembly 20 and table top assembly 50 interact to form the foldable table of the present invention as shown in FIG. 6. Table brace 52 is located far enough away from table brace 53 to allow the insertion therebetween of bench brace 23, outside leg assembly 5 and inside leg assembly 6. Outside leg assembly 5 is coupled to table brace 52 at pivot hole 62 in a manner which will allow outside leg assembly 5 to swing on pivot hole 62. For example, a bolt, washer and stop nut combination can be inserted through pivot hole 62 and mounting hole 16 in a manner which fastens leg assembly 5 to table assembly 50, but allows leg assembly 5 to pivot on the bolt. Spring 18 is attached to spring rod 15 and the other end of spring 18 is attached to table top 51, between table brace 52 and bench brace 23, by inserting a U-bolt, eye hook or other fastening means into table top 51 and hooking spring 18 thereon. As is clear from such a configuration and from the drawings, the open side of spring slots 13 in the leg assemblies face away from the table top 51 so that the springs 18 are accessible. By connecting the spring to the leg and table top in this manner, the leg will easily swing out to an open position.

Inside leg assembly 6 is coupled to table brace 53 at pivot hole 63 in a manner essentially the same to that of outside leg assembly 5, as shown in FIG. 6. Inside leg assembly 7 is coupled to table brace 56 at pivot hole 64 and outside leg assembly 8 is coupled to table brace 57 at pivot hole 65 in a manner substantially identical to outside leg assembly 5 and inside leg assembly 6, as shown in FIG. 6. Structural brace 58 is attached to table brace 55, via a hinge 61, so that it can swing to almost abut table brace 53 as shown.

Figure 7:
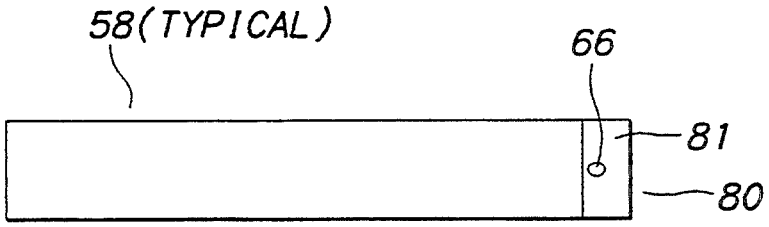
FIG. 7 is a top view of structural brace 58.
Figure 8:
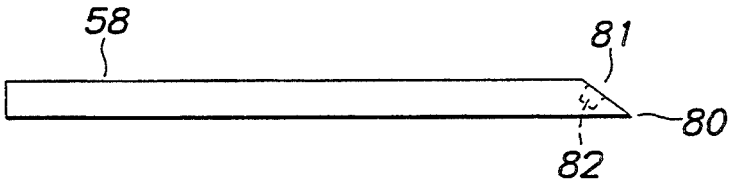
FIG. 8 is a side view of structural brace 58.
Figure 9:
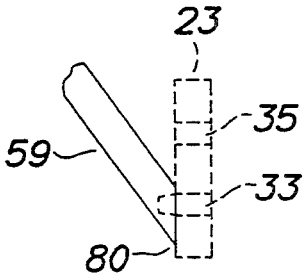
FIG. 9 is a perspective/sectional view showing the interconnection of structural brace 59 to bench brace 23 when the table is in the unfolded position.

As can be seen in more detail in FIG. 7, 8 and 9, the unhinged end 80 of structural braces 58 and 59 is cut on an angle as shown, and a hole 82 is drilled into the angled face 81, perpendicular thereto, to enable insertion of a T-nut or threaded insert (not shown). The T-nut or threaded insert is used to enable the coupling of the structural brace to the bench braces using, for example, a machine threaded rod with a handle or knob attached to one end to allow easy manipulation by the user. When in the unfolded position, structural brace 58 is pivoted on the hinge to abut bench brace 24, so that coupling hole 66 aligns with structural brace anchoring hole 34 of bench brace 24. The precise angle of angled face 81 should be such that, when the structural braces are abutted against the bench braces in the unfolded position, angled face 81 is essentially flush against the bench braces. The structural brace 58 is anchored to bench brace 24 using any suitable means, for example, a machine threaded rod with a handle or knob attached to the end, which is inserted into the T-nut or threaded insert placed in hole 66. In much the same manner, structural brace 59 is attached to table brace 54. The abutting end of structural brace 59 is coupled to bench brace 23, when the table is in the unfolded position, by aligning coupling hole 67 and structural brace anchoring hole 33 and securing same as described above with regard to structural brace 58.

In the folded position, the table top assembly rests essentially on top of the bench assembly, with the shims 29, 30, 31 and 32 "separating" the table top from the benches 21 and 22. The leg assemblies 5, 6, 7 and 8 are folded under the table, extending the springs 18. The tension of the springs should be such that, when the legs are fully folded up under the table top assembly, a slight amount of pressure towards the unfolded position, such as that provided by the forces of gravity, will cause each leg assembly to swing out to an unfolded position. When the leg assemblies 5, 6, 7 and 8 are in the folded position and the table top assembly 50 is resting on the bench assembly 20, the anchoring holes on the table braces, leg assemblies, bench braces and structural braces (70, 17, 35, 17, and 68 on one side and 71, 17, 36, 17, and 69 on the other side) are all in alignment, thereby allowing the insertion of the anchoring rods, for example, wooden dowels (not shown), to hold the folded assembly in the folded position. Each anchoring rod should be of a length that allows it to extend beyond table braces (53 on one end and 56 on the other end) so that they stop the structural braces 58 and 59 from dropping down when the folded table is lifted or moved.

In operation, the folded device is placed on the ground with the table top facing upward. The anchoring rods are then removed, and a person grasps one bench and a second person grasps the other bench. The two persons then lift the whole assembly into the air, and the springs 18, urged by the forces of gravity, cause the leg assemblies 5, 6, 7 and 8 to swing out into the open position, and the structural braces 58 and 59 swing free. The benches are then lowered to rest on the legs, with the stops 25, 26, 27 and 28 engaging notches 14, thereby placing the table in the appropriate position for use. Structural brace 58 is then swung towards bench brace 24 and into abutment therewith, at which point a coupling means is inserted through both to secure same in place. Similarly, structural brace 59 is swung towards bench brace 23 and into abutment therewith, at which point a coupling means is inserted through both to secure same in place.

When the bench assembly is dropped into place by mating stops 25, 26, 27 and 28 with notches 14, anchoring holes 19 on leg assemblies 5, 6, 7, and 8 are aligned with anchoring holes 37, 38, 39 and 40, respectively, in bench braces 23 and 24. Using an appropriate anchoring means such as, for example, a machine threaded rod with a handle or knob attached, the legs are anchored in place to complete the assembly.

The resulting table has many advantages over the prior art folding tables. Since it was designed to be a table first, as opposed to a folding table, the unfolded table has just as much, if not more, structural soundness as that of a nonfoldable table. By placing the legs on either side of the bench braces 23 and 24, the bench assembly and table assembly sandwich in a folded position, and can swing smoothly into the open position.

There are only two hinges needed for construction of the table, thereby simplifying manufacture of the table. The hinged structural braces prevent wobbling when the table is unfolded. By hinging them and situating them as shown, the structural braces can easily fold out of the way when the table is folded. Further, there is no need to add braces to the table; the entire table is anchored in the open position by using 6 fasteners, and it is held together in the folded position by 2 anchoring rods.

The many features and advantages of the invention are apparent from the detailed specification and thus it is intended by the appended claims to cover all such features and advantages of the invention which fall within the true spirit and scope thereof. Further, since numerous modifications and changes will readily occur to those skilled in the art, it is not desired to limit the invention to the exact construction and operation illustrated and described and, accordingly, all suitable modifications and equivalents may be resorted to, falling within the scope of the invention.

I claim:

1. A foldable table structure, comprising:

a table top assembly, said table top assembly including:

a generally rectangular table top;

a plurality of table braces attached to said table top; and at least two structural braces hingedly attached to at least two of said table braces so that said structural braces can be manipulated between a folded and unfolded position;

a bench assembly, said bench assembly including:

two bench brace members which are transversely positioned with respect to said table top;

two seat members which are longitudinally positioned with respect to said table top and which are mounted at corresponding ends of said bench brace members; and four bench stops, one each coupled to each intersection of said bench braces with said seat members, so that one end of each of said bench stops extends inward towards said table top beyond the inner edge of each seat member; and four leg assemblies, each leg assembly pivotally attached to said table top assembly and comprising:

a generally parallelogram-shaped leg body, having a rounded heel end for facilitating the pivoting of said leg assembly with respect to said table top;

a spring slot cut in the heel end of said leg body, said spring rod inserted through said spring slot;

a notch for engagement with one of said bench stops when the table structure is unfolded; and a spring, attached at one end to said spring rod and at the other end to said table top, said table structure operating such that when all four leg assemblies are folded up underneath said table top assembly and the springs are under tension, the table top assembly rests on top of said bench braces with said structural braces in said folded position, so that an anchoring means can be inserted through said table braces, bench braces, and leg assemblies to anchor said table structure in said folded position; and when said anchoring means is removed and the entire table structure is lifted by lifting up on the bench assembly, the leg assemblies, forced by the tension of the springs and by gravity, automatically swing out to an unfolded position, and the bench assembly is then lowered into a position such that the bench stops engage the notches, placing the table structure in the unfolded position.

2. A folding table structure comprising a table top assembly, four leg assemblies with a pair of said leg assemblies located adjacent one end of said table top assembly and another pair of said leg assemblies located adjacent the other end of said table top assembly, each leg assembly being pivotally attached to said table top assembly, two structural braces attached to said table top assembly, and a seat assembly including two benches attached to each other by transverse bench braces, four bench stops, one each coupled to each intersection of said transverse bench braces with said benches, said leg assemblies having springs attached between a spring rod and said table assembly to bias said legs toward an unfolded from a folded position position and each leg assembly having a notch for engagement with said bench stop when the table structure is in the unfolded position, and means for maintaining said table structure and seat assembly in either the folded or unfolded position.

3. A folding table structure comprising a table top assembly, a bench assembly including four bench stops, and four leg assemblies, all being interactively coupled to form said foldable table structure, wherein each said leg assembly comprises:

a generally parallelogram-shaped leg body, having a rounded heel end for facilitating the pivoting of said leg assembly with respect to said table top assembly;

a spring slot cut in the heel end of said leg body;

a spring rod inserted through said spring slot;

a notch for engagement with one of said bench stops when the table structure is unfolded; and a spring, attached at one end to said spring rod and at the other end to said table top assembly, said table structure operating such that when all four leg assemblies are folded up underneath said table top assembly and the springs are under tension, the table top assembly rests on top of said bench assembly and said table structure is thereby in the folded position; and when said table structure is lifted while in the folded position by lifting up on the bench assembly, the leg assemblies, forced by the tension of the springs and by gravity, automatically swing out to an unfolded position, and the bench assembly is then lowered into a position such that the bench stops engage the notches, thereby placing the table structure in the unfolded position.

* * * * *